US005370137A

United States Patent [19]

Kushihashi et al.

[11] Patent Number: 5,370,137

[45] Date of Patent: Dec. 6, 1994

[54] APPARATUS FOR CONTROLLING THE DIAMETER OF CIGARETTES TO BE MANUFACTURED BY MEANS OF A CIGARETTE PRODUCTION MACHINE

[75] Inventors: Shigenobu Kushihashi; Makoto Kakiuchi; Hidenori Muramoto, all of Tokyo, Japan

[73] Assignee: Japan Tobacco Inc., Tokyo, Japan

[21] Appl. No.: 15,859

[22] Filed: Feb. 10, 1993

[30] Foreign Application Priority Data

Feb. 13, 1992 [JP] Japan ..... 4-26550

[51] Int. Cl.[5] ..... A24C 5/18

[52] U.S. Cl. ..... 131/84.2; 131/66.2; 131/84.1; 131/906; 131/905

[58] Field of Search ..... 131/77, 84.2, 84.1, 131/904–906, 908, 84.4, 64.2, 66.2

[56] References Cited

U.S. PATENT DOCUMENTS 2,164,423 7/1939 Podmore .
4,027,137 5/1977 Liedtke .
4,164,229 8/1979 Hurt ..... 131/84.4 X
4,688,583 8/1987 Neri ..... 131/84.2
4,865,054 9/1989 Lorenzen et al. ..... 131/906 X
4,986,285 1/1991 Radzio et al. ..... 131/906 X

FOREIGN PATENT DOCUMENTS 0294211 12/1988 European Pat. Off. .
0390234 10/1990 European Pat. Off. .
2836030 3/1979 Germany ..... 131/84.1
3541142 11/1985 Germany .

*Primary Examiner*—Jennifer Bahr

[57] ABSTRACT

A control apparatus according to the present invention comprises a hinge for rockably supporting a second upper mold, which is utilized for the final formation of a tobacco rod, right over a lower mold of a cigarette production machine, an adjusting device for adjusting the diameter of the tobacco rod by rocking the second upper mold, a pulse motor for use as a drive source for the adjusting device, a pair of sensors for measuring diametrical widths of the formed tobacco rod with respect to two directions perpendicular to each other, a central processing unit for controlling the drive of the pulse motor in accordance with output signals from the sensors so that the diameter of the tobacco rod to be formed are within an allowable range, by means of a drive controller for the pulse motor.

9 Claims, 13 Drawing Sheets

APPARATUS FOR CONTROLLING THE DIAMETER OF CIGARETTES TO BE MANUFACTURED BY MEANS OF A CIGARETTE PRODUCTION MACHINE

BACKGROUND OF THE INVENTION

1. Field of the Invention

The present invention relates to a control apparatus incorporated in a cigarette production machine and used to control the diameter of cigarettes or a tobacco rod during the formation thereof.

2. Description of the Related Art

In a process for running an elongate paper in one direction, a cigarette production machine first forms a tobacco rod while continuously wrapping shredded tobacco in the paper, and then cuts the formed tobacco rod into individual cigarettes with a predetermined length.

More specifically, the tobacco rod is formed in the following manner. On receiving the shredded tobacco, the paper travels on a lower mold. During this traveling process, the paper is first curved by means of the lower mold into a U-shaped configuration such that it envelops the shredded tobacco from below. As the U-shaped paper passes between the lower mold and a first upper mold, thereafter, one side of the paper is curved by means of the first upper mold into an arcuate configuration such that it overhangs the shredded tobacco. As the U-shaped paper then passes between the lower mold and a second upper mold, moreover, the other side of the paper is also curved by means of the second upper mold into an arcuate configuration such that it overhangs the shredded tobacco in like manner. At the same time, the other side of the paper is lapped and pasted on the one side, whereupon the tobacco rod is completed.

Since the tobacco rod is continuously formed by means of the lower and upper molds while the paper is traveling, as described above, it is very difficult to stabilize the diameter of the formed tobacco rod. Inevitably, therefore, the diameter of the tobacco rod varies in some measure during production.

If the diameter of the tobacco rod is greater than allowable limits, however, the width of a lap portion at which the opposite side edges of the paper meet is so narrow that the two edges cannot be perfectly pasted together, and the shredded tobacco cannot be wrapped in the paper in some cases.

After the cigarettes are produced in this manner, filter cigarettes may be obtained by connecting a filter plug to each cigarette by means of a tip paper piece. If the diameter of the cigarettes or tobacco rod is subject to a substantial variation, in this case, the connection of each cigarette and the filter plug by means of the tip paper piece is imperfect.

Thus, if the diameter of the tobacco rod is too small, a gap is inevitably formed between the tip paper piece and each cigarette due to the difference in diameter between the filter plug and the cigarette. Since this gap causes an undesirable increase of the amount of air which flows through the filter plug into a smoker's mouth, constituents of tobacco smoke change, thereby exerting a bad influence upon the taste of the tobacco.

If the diameter of the tobacco rod is too large, on the other hand, the compressive force of the paper on the shredded tobacco is so small that the tobacco may slip out of the cut end of the cigarette, or that the cigarette itself is liable to be deformed or spoiled in external appearance.

If the difference in diameter between the filter plug and the cigarette is great, moreover, the tip paper piece is liable to winding failure, so that it creases. Thus, the external appearance of the filter cigarette is considerably damaged.

In consideration of these circumstances, an operator of the cigarette production machine monitors time lap width of the tobacco rod during the operation of the machine. If the lap width is deviated from an allowable range, the operator must manually operate the second upper mold to adjust its position with respect to the lower mold. The diameter of the tobacco rod can be set within the allowable range by this adjustment.

Visual inspection of the lap width of the tobacco rod is very difficult, however, since the tobacco rod itself is traveling at high speed with deflection. Since the position of the second upper mold is manually adjusted, moreover, the accuracy of the position adjustment depends substantially on the operator's skill.

Accordingly, there is a demand for the development of an apparatus which can automatically adjust the diameter of the tobacco rod, and this development first requires an accurate measurement of the rod diameter. As mentioned before, however, the tobacco rod undergoes deflection as it travels, so that measuring its diameter is a very hard task.

SUMMARY OF THE INVENTION

The object of the present invention is to provide an apparatus capable of accurately measuring the diameter of a tobacco rod and automatically adjusting the rod diameter within an allowable range on the basis of the measurement result.

The above object is achieved by a control apparatus according to the present invention, which is applied to a cigarette production machine of the aforementioned type. The cigarette production machine comprises a lower mold, a first upper mold, a second upper mold, cutting means for cutting a formed tobacco rod into individual cigarettes, and paste applying means for applying paste to the other side edge of a U-shaped paper curved by means of the lower mold before the paper passes the second upper mold.

The control apparatus of the invention comprises supporting means for supporting the second upper mold right over the lower mold, adjusting means for varying the position of the second upper mold with respect to the lower mold in cooperation with the supporting means, thereby adjusting the diameter of the tobacco rod to be formed, measuring means for measuring diametrical widths of the formed tobacco rod or cigarettes with respect to different directions and outputting measurement results, and control means for controlling the adjusting means in accordance with the measurement results so that the diameter of the tobacco rod to be formed are within an allowable range.

According to the control apparatus described above, the diametrical widths of the formed tobacco rod are measured with respect to two directions perpendicular to each other by means of the measuring means, and the measurement results are supplied to the control means. Based on the measurement results, the control means calculates the diameter of the tobacco rod, and determines whether or not these diameters are within the allowable range. If the diameter of the tobacco rod is deviated from the allowable range, the control means controls the adjusting means to change the position of the second upper mold with respect to the lower mold, thereby setting the diameter of the tobacco rod to be formed within the allowable range.

If the above control apparatus is incorporated in the cigarette production machine, the diameter of the tobacco rod to be formed is controlled to be within the allowable range, so that a lap portion of the paper of the tobacco rod cannot be subject to any bonding failure. Accordingly, the quality of the cigarettes obtained by cutting the tobacco rod afterward can be improved. In producing filter cigarettes by connecting a filter plug to each cigarette, moreover, a tip paper piece can be satisfactorily wound around the cigarette and filter plug if the rod diameter is stable. Thus, the quality of the filter cigarettes can be also improved.

BRIEF DESCRIPTION OF THE DRAWINGS

The present invention, together with its objects and advantages, will be more fully understood from the ensuing detailed description and the accompanying drawings, which are given by way of illustration only, and thus, are not limitative of the present invention, and wherein.

DETAILED DESCRIPTION OF THE PREFERRED EMBODIMENTS

Figure 1:
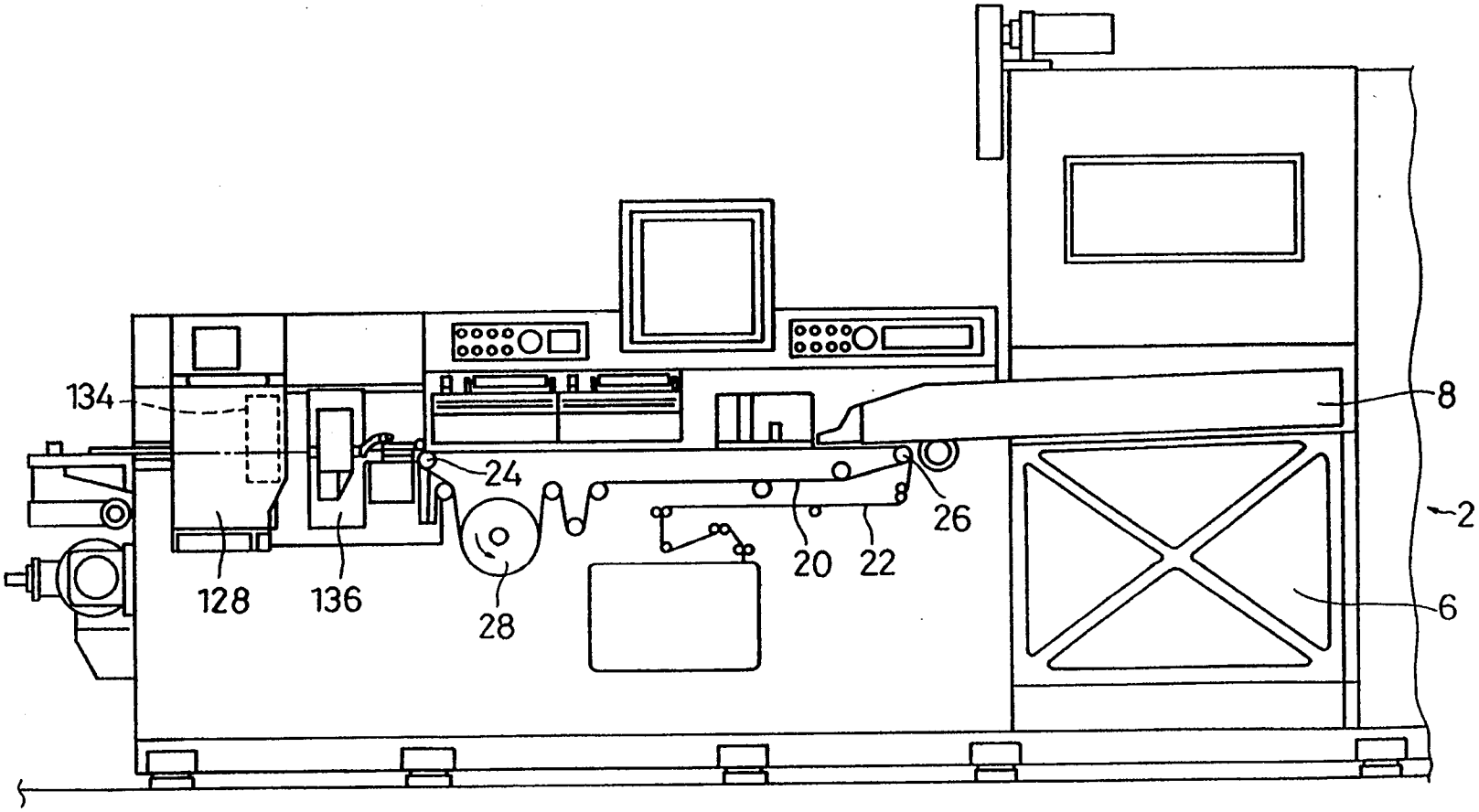
FIG. 1 is a front view schematically showing a cigarette production machine.
Figure 2:
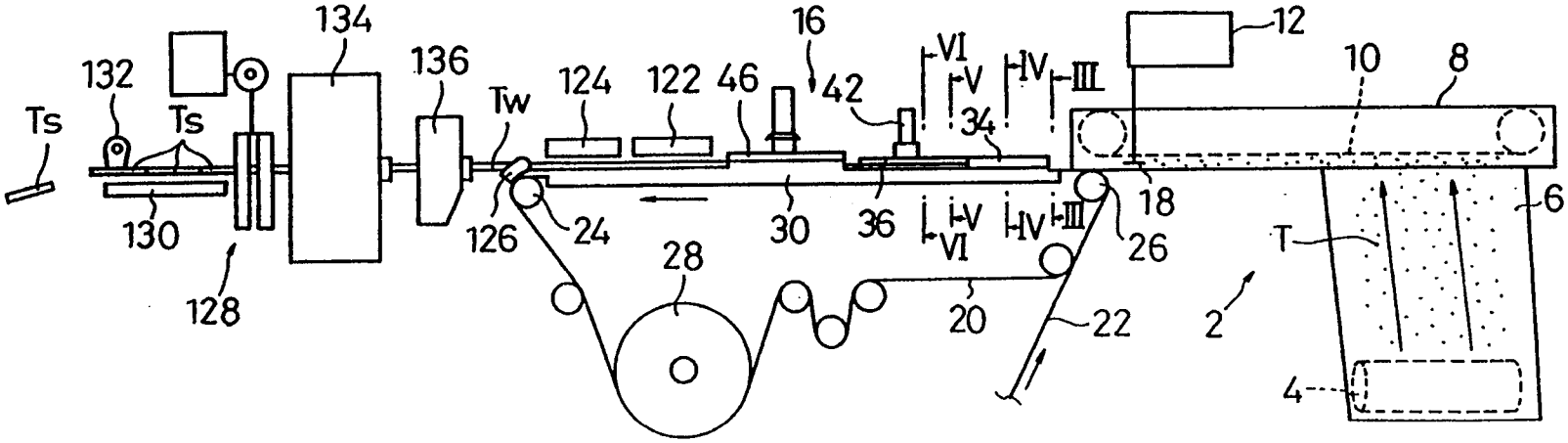
FIG. 2 is a schematic view for illustrating the function of the cigarette production machine of FIG. 1.

Referring now to FIGS. 1 and 2, there is shown a cigarette production machine which comprises a supply section 2 for shredded tobacco T. The supply section 2 includes a supply drum 4, which is located in the bottom portion of a chimney 6. The supply drum 4 serves to guide the shredded tobacco T into the chimney 6, and the chimney 6 to suck up the tobacco T together with air.

The top portion of the chimney 6 is covered by a conveyor unit 8, one end of which extends from the chimney 6. The conveyor unit 8 has a metallic conveyor belt 10 built-in, which is overspread with a number of small holes. Thus, the shredded tobacco T, sucked up together with an air current in the chimney 6, is caught by the conveyor belt 10, that is, it is attracted to the lower surface of the belt 10 to form a layer thereon. As the conveyor belt 10 travels, therefore, the shredded tobacco T is transported to the left of FIGS. 1 and 2 from the supply section 2.

A trimming device 12 (see FIG. 2), which is disposed right under the conveyor belt 10, serves to adjust the thickness of the shredded tobacco T adhering to the belt 10. More specifically, the device 12 includes a rotatable trimming disk 18, which scrapes off a part of the shredded tobacco T from the conveyor belt 10 by rotating. Thus, the thickness of the shredded tobacco T on the conveyor belt 10, that is, the amount of tobacco supply from the conveyor unit 8 is adjusted by regulating the space between the belt 10 and the trimming disk 18.

A wrapping section 16 extends from the one end portion of the conveyor unit 8. The shredded tobacco T supplied from the conveyor unit 8 is transferred to the surface of a paper 22 which is joined together with a cloth garniture tape 20. As the garniture tape 20 travels, the paper 22 is delivered from a paper roll (not shown).

As shown in FIG. 2, the garniture tape 20 is passed around a number of rollers. That portion of the tape 20 which is situated between a pair of rollers 24 and 26, among the other rollers, extends horizontally in the wrapping section 16.

Further, the garniture tape 20 is passed around a driving drum 28 so that it travels past the drum 28. Thus, when the driving drum 28 is rotated in one direction by means of a drive source (not shown) for rotation, the garniture tape 20 travels in the direction indicated by the arrow in FIG. 2.

As the garniture tape 20 travels in this manner, the paper 22 on the tape 20, along with the shredded tobacco T thereon, travels in the one direction, and enters the wrapping section 16.

In time wrapping section 16, the configuration of travel path of the paper 22 varies in the manner shown in FIGS. 3 to 6. As the paper 22, along with the shredded tobacco T thereon, travels along the travel path, therefore, the tobacco T is wrapped in the paper 22, whereby a continuous tobacco rod $T_W$ is formed.

Figure 3:
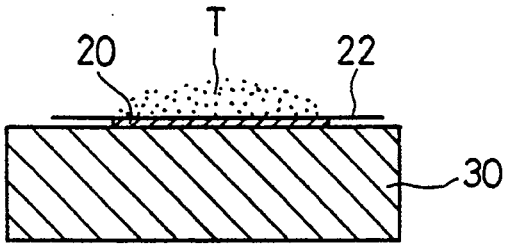
FIG. 3 is a sectional view taken along line III—III of FIG. 2.

The following is a detailed description of the wrapping section 16. The wrapping section 16 is provided with a lower mold 30 which is formed of an elongate plate. The lower mold 30 extends horizontally in the traveling direction of the paper 22 or the garniture tape 20. The upstream portion of the top face of the lower mold 30, with respect to the traveling direction of paper 22, is a flat surface, as shown in FIG. 3. Therefore, the garniture tape 20 is in sliding contact with this flat surface as it travels together with the paper 22.

That portion of the top face of the lower mold 30 which is situated on the downstream side of the flat surface is formed as a guide tongue (not shown). This guide tongue is formed of a recess which gradually converges into a traveling groove 32 (see FIG. 4) with a semicircular cross section with distance from the upstream side, with respect to the traveling direction of the garniture tape 20.

Figure 4:
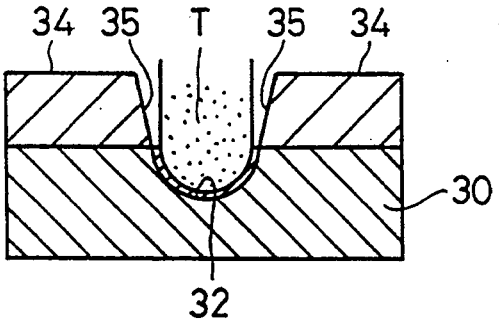
FIG. 4 is a sectional view taken along line IV—IV of FIG. 2.

On the top face of the lower mold 30, as shown in FIG. 4, a pair of side guides 34 are arranged individually along the opposite side edges of the guide tongue. The space between facing guide surfaces 35 of the side guides 34 is also reduced so as to converge into the traveling groove 32. The guide surfaces 35 ascend so that the distance between them increases upward.

When the paper 22, along with the shredded tobacco T, is introduced into the guide tongue and the space between the side guides 34 as the garniture tape 20 travels, both side edges of the paper 22 are lifted, as shown in FIG. 4. When the paper 22 enters the traveling groove 32, thereafter, its central portion is curved into a semicircular configuration. Thus, the guide tongue and the side guides 34 make the paper 22 U-shaped in cross section in a manner such that the shredded tobacco T is wrapped in the paper 22 from below. Thus, the U-shaped paper 22 has a pair of sides and a curved portion connecting the sides.

The garniture tape 20 has a width substantially equal to the length of the circular are of the traveling groove 32, and the groove 32 extends to the downstream end of the lower mold 30.

Figure 5:
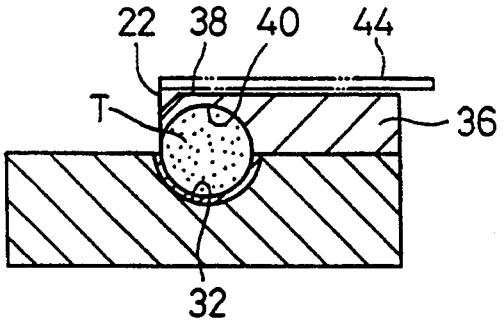
FIG. 5 is a sectional view taken along line V—V of FIG. 2.
Figure 6:
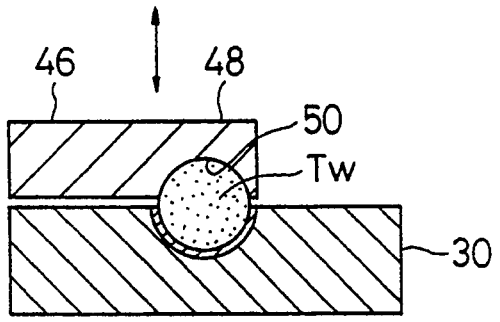
FIG. 6 is a sectional view taken along line VI—VI of FIG. 2.

A first upper mold 36 is set on the top face of the lower mold 30. The mold 36, which is situated on the downstream side of the side guides 34, extends along one side of the traveling groove 32. As shown in FIG. 5, the first upper mold 36 has a lid portion 38 which hangs over the traveling groove 32, and an arcuate groove 40 is formed in the lower surface of the lid portion 38 so as to extend facing the traveling groove 32. The groove 40 has a half- funnel-shaped configuration (not shown) such that it spreads out toward the side guides 34.

Further, the upstream part of the lid portion 38 of the first upper mold 36 is obliquely cut off and the lid portion 38 has an oblique end crossing the traveling groove 32. This oblique end constitutes a guide edge. When the U- shaped paper 22 travels past the first upper mold 36, therefore, one side of the paper 22 is pushed into the arcuate groove 40 in a manner such that it is guided by the guide edge of the lid portion 38. Thus, the one side of the paper 22 is curved in the form of a circular are such that it envelops the shredded tobacco T from above. Here it is to be noted that the one side (not clearly shown in FIG. 5) of the paper 22 extends along the arcuate groove 40 to a position just beyond the top portion of the groove 40.

After the one side of the paper 22 is curved in this manner, paste is applied to the other side edge of the paper 22 by means of a paste applicator 42 (see FIG. 2). More specifically, the paste applicator 42 includes an applicator disk 44, which is indicated by two-dot chain line in FIG. 5. The disk 44 is brought into rolling contact with the other side edge of the paper 22, thereby applying a predetermined amount of paste on this side edge.

Further, a second upper mold 46 is set on the top face of the lower mold 30 so as to be situated on the downstream side of the first upper mold 36. The second upper mold 46 is continuous with the first upper mold 36. Unlike the first one, however, the second upper mold 46 extends along the other side of the traveling groove 32.

The second upper mold 46, like the first upper mold 36, has a lid portion 48 which hangs over the traveling groove 32, and an arcuate groove 50 is formed in the lower surface of the lid portion 48 so as to extend facing the traveling groove 32. The groove 50, like the arcuate groove 40, has a half- funnel-shaped configuration, and the lid portion 48 has an oblique end which constitutes a guide edge. The guide edge of the lid portion 48 is inclined in the opposite direction to that of the lid portion 38.

When the paper 22 in the state shown in FIG. 5 travels past the second upper mold 46, therefore, the other side of the paper 22 is pushed into the arcuate groove 50 in a manner such that it is guided by the guide edge of the lid portion 48. Thus, the other side of the paper 22 is curved in the form of a circular arc such that it envelops the shredded tobacco T from above.

Figure 7:
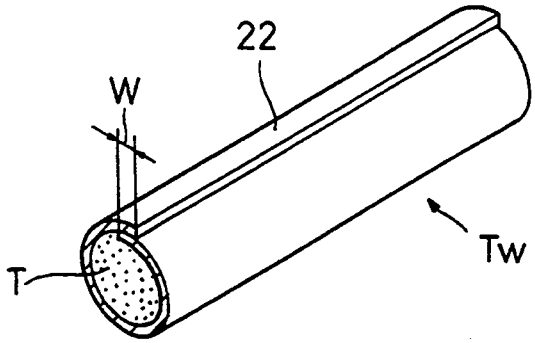
FIG. 7 is a perspective view illustrating part of a formed tobacco rod.

At this time, the other side of the paper 22 is lapped on and bonded to the previously curved one side. Thus, when the paper 22 travels past the second upper mold 46, the continuous tobacco rod $T_W$, such as the one shown in FIG. 7, is discharged from between the lower mold 30 and the second upper mold 46.

In this embodiment, the second upper mold 46 is supported for a vertical displacement such that it approaches and leaves the lower mold 30. Accordingly, the inside diameter of a formation path for the tobacco rod $T_W$, which is defined by the traveling groove 32 and the arcuate groove 50 of the second upper mold 46, can be varied depending on the vertical position of the mold 46. Thus, the diameter of the tobacco rod $T_W$ to be formed can be adjusted. It is to be understood that when the rod diameter is adjusted in this manner, the lap width W of the opposite sides of the paper 22, in the tobacco rod $T_W$ shown in FIG. 7, is adjusted at the same time.

Figure 8:
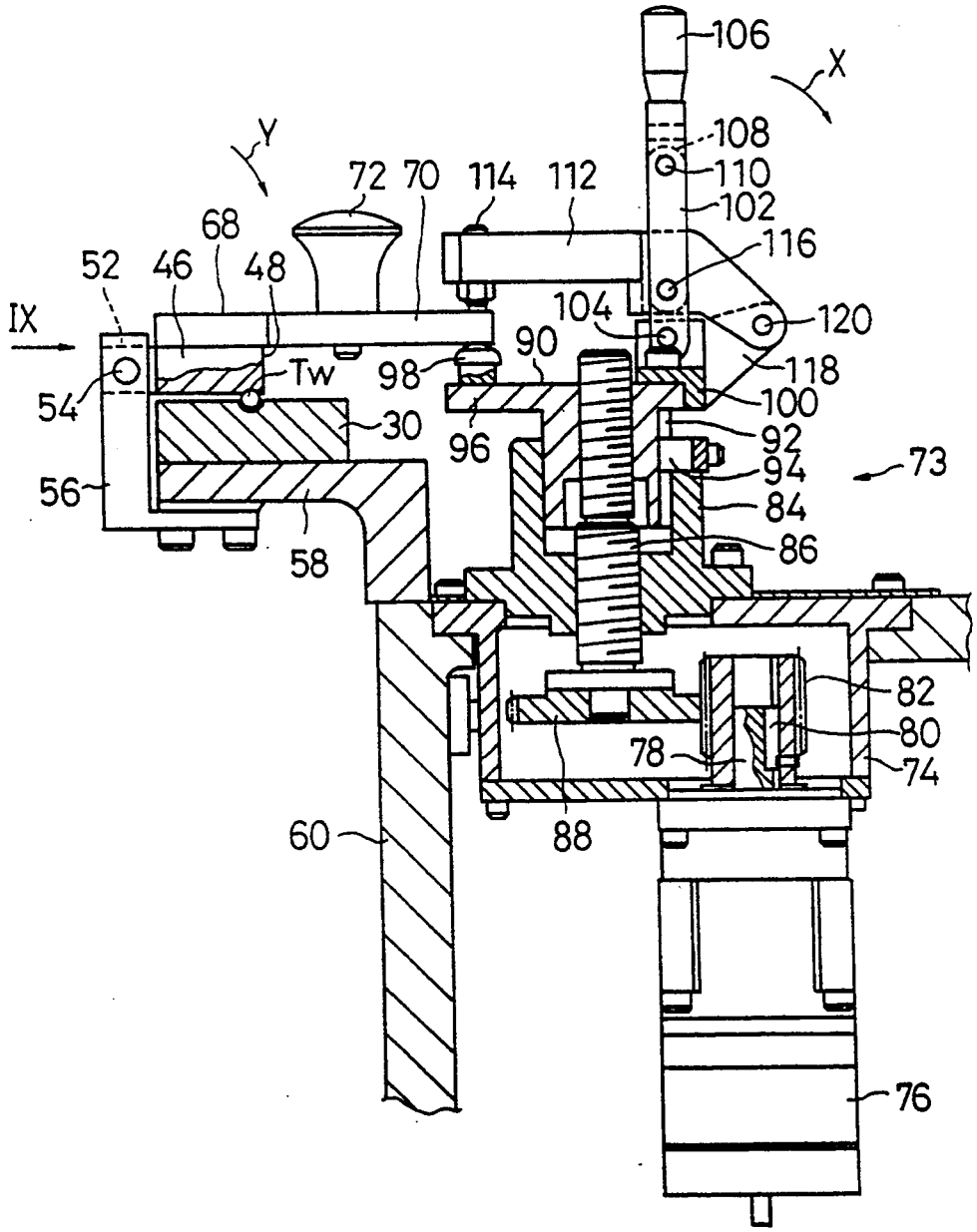
FIG. 8 is a sectional view illustrating supporting/adjusting mechanism for a second upper mold shown in FIG. 6.
Figure 9:
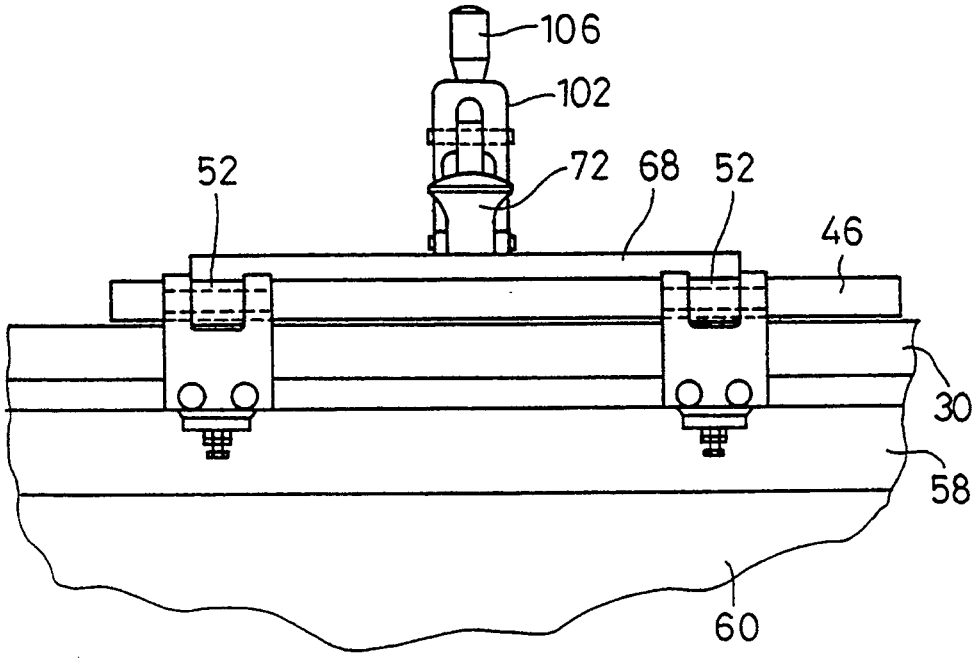
FIG. 9 is a fragmentary view taken in the direction of arrow IX of FIG. 8.

FIGS. 8 and 9 show in detail supporting/adjusting mechanism for the vertical displacement of the second upper mold 46. The following is a description of the mechanism.

The second upper mold 46 includes a pair of lugs 52, which protrude from that side face of the mold 46 on the opposite side to the lid portion 48. As shown in FIG. 9, these lugs 52 are spaced in the traveling direction of the tobacco rod $T_W$, and are rotatably connected to their corresponding brackets 56 by means of hinge pins 54, individually. Thus, the second upper mold 46 is vertically swingable around the pins 54.

The brackets 56 are fixedly mounted on a support base 58 of the lower mold 30. The base 58 is mounted on a main frame 60 of the cigarette production machine.

A driving arm 70 is mounted on the top face of the second upper mold 46 by means of a connecting plate 68. The plate 68 and the arm 70 are formed integrally with each other. The driving arm 70 projects in the opposite direction to the lugs 52 from the second upper mold 46. A grip 72 is attached to the central portion of the upper surface of the driving arm 70, the distal end of which is connected to the adjusting device 73.

The adjusting device 73 is provided with a gear housing 74 which is fixed to the main frame 60, and a reversible pulse motor 76 is mounted on the lower surface of the housing 74. The motor 76 has an output shaft 78 which projects into the gear housing 74, and an output gear 82 is mounted on the output shaft 78 by means of a key 80.

A screw housing 84 is mounted on the upper surface of the gear housing 74. The housing 84 has an open-topped cylinder hole. A stepped screw shaft 86 penetrates the bottom wall of the cylinder hole of the screw housing 84. The screw shaft 86 has a large- and small-diameter screw portions arranged from bottom to top, and the large-diameter screw portion threadedly penetrates the bottom wall of the screw housing 84. Thus, the lower end of the shaft 86 projects into the gear housing 74. A driving gear 88, which is mounted on the lower end of the screw shaft 86, is in mesh with the output gear 82 of the pulse motor 76.

A lift cylinder 90 is slidably fitted in the cylinder hole of the screw housing 84. The small-diameter screw portion of the screw shaft 86 is penetratingly screwed in the lift cylinder 90. A hole having a diameter larger than that of the large-diameter portion of the screw shaft 86 is formed in the bottom face of the lift cylinder 90, and an axial groove 92 is formed in the outer peripheral surface of the cylinder 90. A stopper key 94, which is fitted in the groove 92, is fixed to the screw housing 84. Thus, the lift cylinder 90 is prevented from rotating around its own axis, although it is movable in the axial direction.

A projecting piece 96 is formed integrally on the upper end of the cylinder 90, which projects from the screw housing 84. The piece 96, which extends toward the driving arm 70 of the second upper mold 46, is fitted with a pad 98 which supports the distal end of the arm 70 from below.

Meanwhile, a bracket 100 is mounted on the upper end of the lift cylinder 90 so as to be situated on the opposite side thereof to the projecting piece 96. The lower end of clamp lever 102 is rockably set up on the bracket 100 by means of a hinge pin 104. As seen from FIG. 9, the clamp lever 102 is in the form of an inverted tuning fork, and a grip 106 is attached to the upper end of the lever 102.

A toggle link 108 is disposed in the clamp lever 102. The upper end of the link 108 is rockably mounted on the clamp lever 102 by means of a hinge pin 110.

A clamp arm 112 penetrates the lower part of the clamp lever 102. One end of the clamp arm 112 extends toward the driving arm 70, and a setscrew 114 is screwed in the one end of the arm 112. The distal end portion of the driving arm 70 is held between the setscrew 114 and the pad 98 on the projecting piece 96.

The other end portion of the clamp arm 112, which is bifurcated, holds the lower end portion of the toggle link 108 from both sides. It is bent downward from the position where it projects outside the clamp lever 102. The bifurcated portion of the clamp arm 112 is rockably mounted on the lower end of the toggle link 108 by means of a hinge pin 116, on the one side, and is rockably connected to a tail portion 118, which extends integrally from the bracket 100, by means of a hinge pin 120, on the other side.

Thus, when the clamp lever 102 is set up vertically, as shown in FIG. 8, the distal end portion of the driving arm 70 is held between the pad 98 and the setscrew 114 under a predetermined force of pressure. When the clamp lever 102, in this state, is rocked in the direction of arrow X of FIG. 8, the clamp arm 112 also rocks in the direction of arrow X around the hinge pin 120, whereupon the driving arm 70 is allowed to be released from the hold.

When the pulse motor 76 is driven, in the adjusting device 73 described above, the rotation of the output gear 82 of the motor 76 is transmitted to the screw shaft 86 via the driving gear 88, thereby rotating the shaft 86 and raising or lowering it with respect to the screw housing 84.

As the screw shaft 86 ascends or descends while rotating in this manner, the lift cylinder 90 also ascends or descends at the same time. Accordingly, the driving arm 70 is rocked in the direction of arrow Y of FIG. 8 around the hinge pin 54 with its distal end kept between the pad 98 of the cylinder 90 and the setscrew 114 of the clamp arm 112. As a result, the second upper mold 46, along with the driving arm 70, also rocks in like manner, whereupon the position of mold 46 relative to the lower mold 30 is adjusted.

As seen again from FIG. 2, a pair of dryers 122 and 124 are successively arranged on the lower-course side of the second upper mold 46. These dryers 122 and 124 are situated right over the lower mold 30. Thus, the tobacco rod $T_W$ travels right under the dryers 122 and 124 immediately after passing the second upper mold 46, whereby the paste on the lap portion of the rod $T_W$ is dried.

The tobacco rod $T_W$, thus dried by means of the dryers 122 and 124, comes out from the traveling groove 32 of the lower mold 30, travels past a feed-in deflector 126, and is supplied to a cutting section 128. The feed-in deflector 126 serves automatically to adjust the timing for the supply of the tobacco rod $T_W$ at the start of the operation of the cigarette production machine. The cutting section 128 cuts the tobacco rod $T_W$ into pieces or cigarettes $T_S$ having a fixed length. Thereafter, the cigarettes $T_S$ are successively fed and guided along a rail 130, and are then supplied to the next stage by means of a kicker 132.

A density measuring section 134 and a diameter measuring section 136 are successively arranged between the cutting section 128 and the feed-in deflector 126, the former being situated closer to the cutting section 128. As shown in FIG. 1, the density measuring section 134 is incorporated into the housing of the cutting section 128. The measuring sections 134 and 136 are used to measure the filling density of the shredded tobacco T in the tobacco rod $T_W$ and the diameter of the rod $T_W$, respectively.

The density measuring section 134 includes a scanning head (not shown) and a measuring circuit (not shown). The scanning head emits radiation toward the tobacco rod $T_W$. The measuring circuit detects the radiation transmitted through the tobacco rod $T_W$, and calculates the filling density of the shredded tobacco T in accordance with the result of the detection. The output of the measuring circuit is supplied to the trimming device 12, whereupon the device 12 adjusts the delivery of the shredded tobacco T onto the paper 22 on the basis of the output from the measuring circuit, that is, the tobacco filling density. More specifically, the disk 18 of the trimming device 12 moves up and down, depending on the tobacco filling density, whereby the thickness of the shredded tobacco T on the conveyor belt 10 is adjusted.

Figure 10:
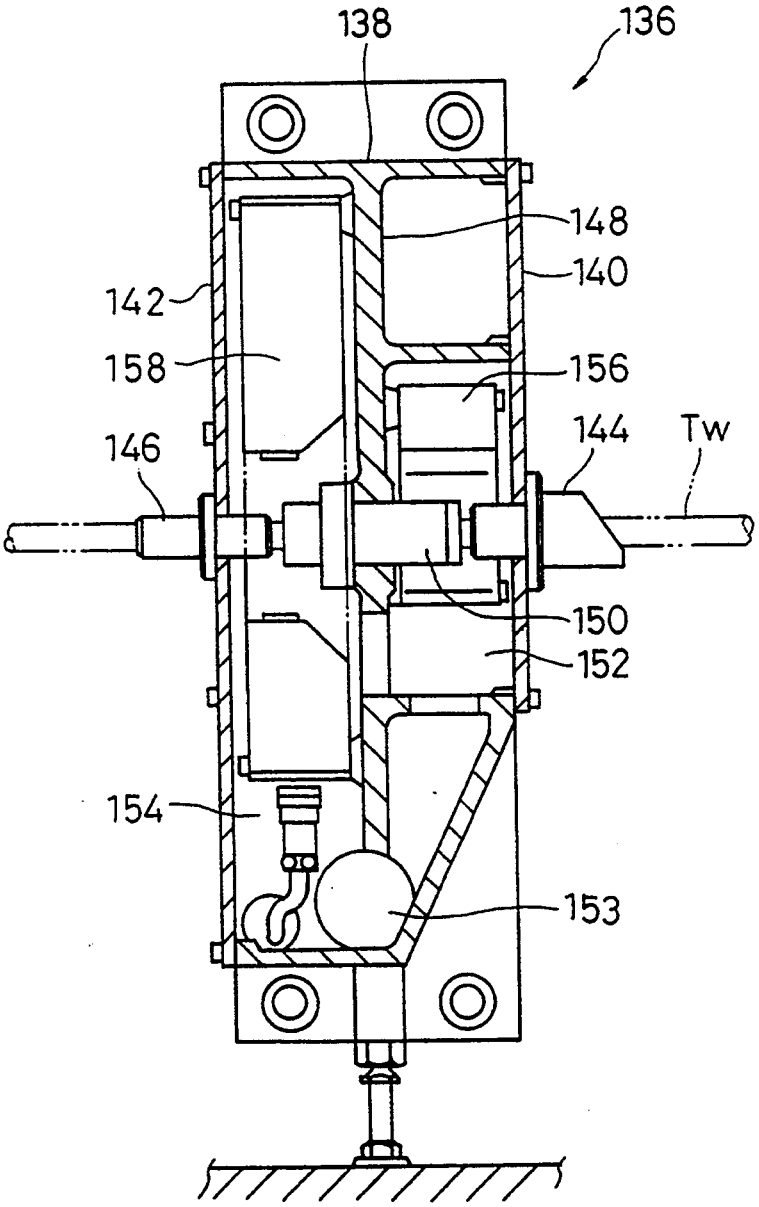
FIG. 10 is a longitudinal sectional view illustrating a diameter measuring section.
Figure 11:
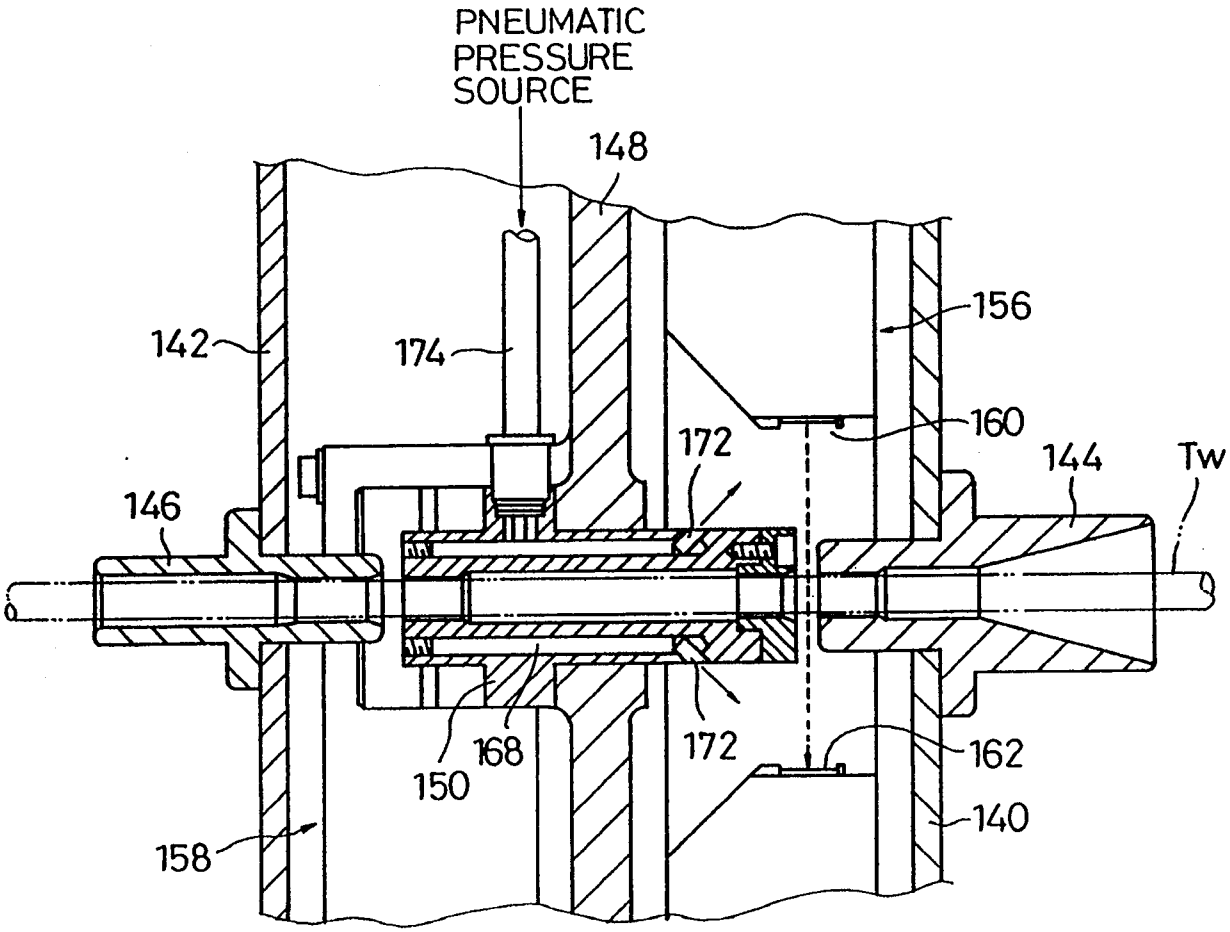
FIG. 11 is a cross-sectional view illustrating an inlet piece, intermediate piece, and output piece shown in FIG. 10.
Figure 12:
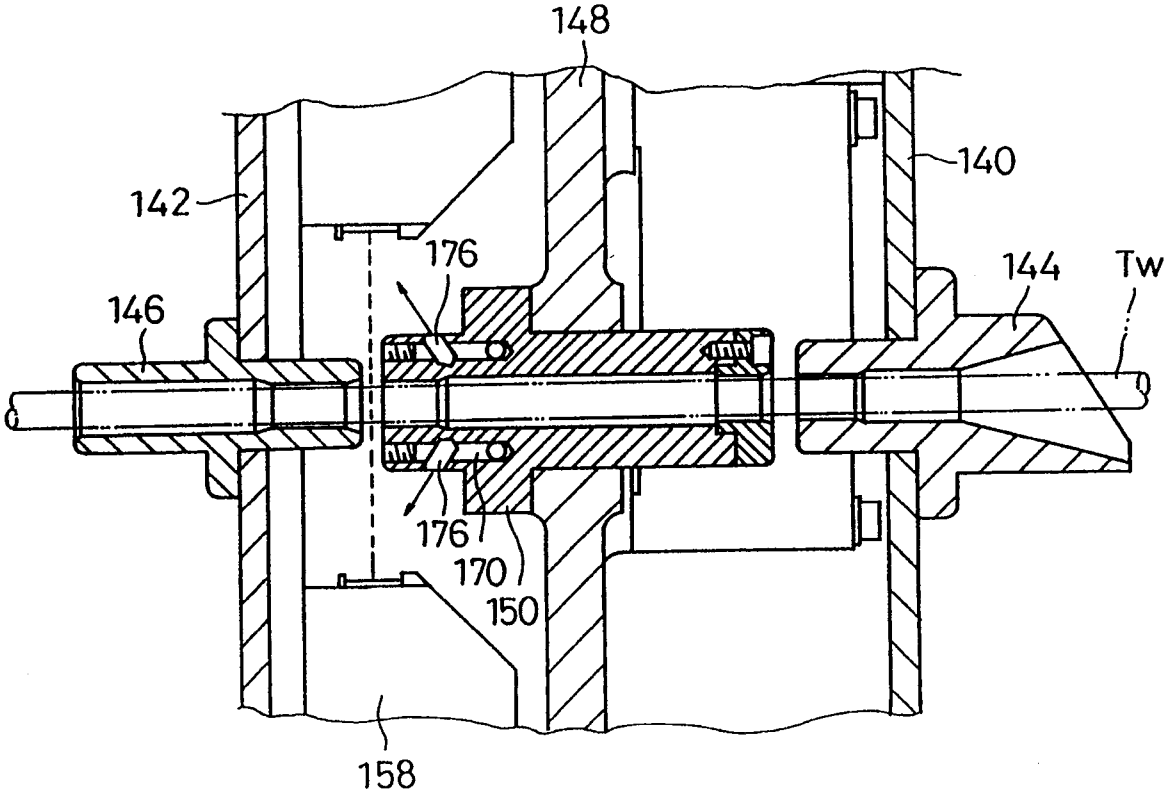
FIG. 12 is a longitudinal sectional view illustrating the inlet piece, intermediate piece, and output piece shown in FIG. 10.

FIGS. 10, 11 and 12 show the diameter measuring section 136 in detail. The following is a description of this measuring section 136.

As shown in FIG. 10, the diameter measuring section 136 is provided with a housing 138. The housing 138 includes cover plates 140 and 142 which face feed-in deflector 126 and the density measuring section 134, respectively. Pipe-shaped inlet and outlet pieces 144 and 146 are attached to the cover plates 140 and 142, respectively. Further, the housing 138 has a partition wall 148 therein which extends parallel to the cover plates 140 and 142, and a pipe-shaped intermediate piece 150 is penetratingly attached to the wall 148.

The pieces 144, 150 and 146, which are arranged coaxially with one another, define the path of travel of the tobacco rod $T_W$. Thus, the tobacco rod $T_W$ delivered from the feed-in deflector 126 is guided in the inlet piece 144, intermediate piece 150, and outlet piece 146 in succession as it passes through the housing 138.

As seen from FIGS. 11 and 12, moreover, the internal passage of the inlet piece 144 is gradually spread toward its inlet port, and the upper portion of the inlet port of the piece 144 is cut aslant. Therefore, the formed tobacco rod $T_W$ can be smoothly guided into the inlet piece 144 with stability.

The partition wall 148 divides the inside of the housing 138 into two compartments 152 and 154, front and rear with respect to the traveling direction of the tobacco rod $T_W$. Sensors 156 and 158 for detecting diametrical widths of the tobacco rod $T_W$ are contained in the compartments 152 and 154, respectively.

The sensor 156 has a case which spans the path of travel of the tobacco rod $T_W$. The case includes a projector portion 160 and a receptor portion 162 which horizontally face each other across the traveling path of the tobacco rod $T_W$. The projector portion 160 emits laser beams, which passes through a gap between the inlet piece 144 and the intermediate piece 150, and is received by the receptor portion 162. Thus, the sensor 156 measures the diametrical width of the tobacco rod $T_W$ with respect to the vertical direction, on the basis of the laser beams having reached the receptor portion 162.

Figure 13:
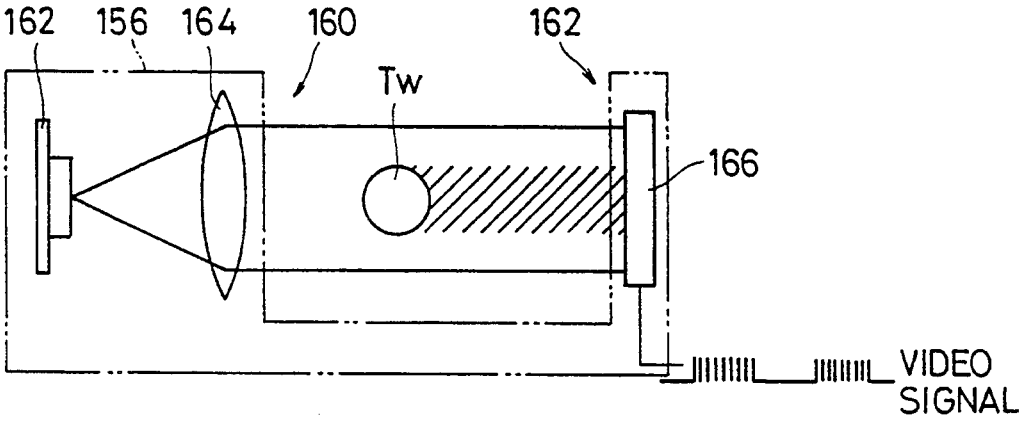
FIG. 13 is a diagram for illustrating the principle of measurement of a sensor for detecting one diametrical width of the tobacco rod.

Referring to FIG. 13, there is shown the principle of measurement of the sensor 156. In this embodiment, the projector portion 160 includes a semiconductor laser element 164 and a collimator lens 166 for collimating the laser beams from the semiconductor element 164 into parallel beams. The receptor portion 162, on the other hand, includes a linear photodiode array 166. On receiving the laser beams from the projector portion 160, each photodiode of the array 166 outputs a receptor voltage. The delivery of the output from each photodiode of the array 166 is detected by scanning for each period, and the output voltage is converted into a pulse signal.

Thus, when the tobacco rod $T_W$ passes between the projector portion 160 and the receptor portion 162 of time sensor 156, as shown in FIG. 13, that part of the laser beams from the projector portion 160 which are intercepted by the rod $T_W$ cannot reach the receptor portion 162. In time array 166 of the receptor portion 162, therefore, no receptor voltage is delivered from time photodiodes in those regions which are intercepted by the tobacco rod $T_W$, and the receptor voltage is delivered only from the photodiodes in the other regions. Accordingly, if only low-level pulse signals are counted out of the pulse signals indicative of the presence of outputs from the individual photodiodes of the array 166, then the resulting value indicates the number of those photodiodes which are intercepted by time tobacco rod $T_W$. Thus, the vertical width of the tobacco rod $T_W$ is measured on the basis of the count value and the interval between the photodiodes.

The pulse signals are converted into video signals as required, and the video signals are supplied to a CRT (not shown). In this case, the vertical width of the tobacco rod $T_W$ is displayed on the CRT.

On the other hand, the sensor 158, which has the same construction and principle of measurement as the sensor 156, is arranged so that its projector and receptor portions 160 and 162 vertically face each other. Laser beams emitted from the projector portion 160 of the sensor 158 can pass through a gap between the intermediate piece 150 and the outlet piece 146 to reach the receptor portion 162. Thus, the sensor 158 measures the diametrical width of the tobacco rod $T_W$ with respect to the horizontal direction.

In this embodiment, moreover, two pairs of delivery passages 168 and 170 for compressed air, besides the internal passage for guiding the tobacco rod $T_W$, are defined in the intermediate piece 150. One end of each of the delivery passages 168 is connected to its corresponding jet 172, while the other end thereof is connected to a pneumatic pressure source by means of a supply hose 174. Each jet 172 opens in the outer peripheral surface of the intermediate piece 150, and its axis is directed to the projector or receptor portion 160 or 162 of the sensor 156 corresponding thereto.

Also, one end of each of the delivery passages 170 is connected to its corresponding jet 176, which opens to the projector or receptor portion 160 or 162 of the sensor 158 corresponding thereto, while the other end of the passage 170 is connected to the pneumatic pressure source by means of the supply hose 174. An end portion (not shown) of the hose 174 is branched, and each branch end is connected to its corresponding delivery passage.

If the intermediate piece 150 is thus provided with the jets 172 and 176, compressed air can be ejected from the jets 172 and 176 toward the projector and receptor portions 160 and 162 of the sensors 156 and 158, respectively, during the operation of the production machine. By doing this, dust or the like adhering to the projector and receptor portions 160 and 162 can be blown off and thereby removed. Thus, the measuring accuracy of the sensors 156 and 158 cannot be adversely affected by dust or the like.

A duct hole 153, which opens into the respective bottom portions of the compartments 152 and 154, is connected to a negative pressure source (not shown) by means of a suction hose (not shown). Thus, the dust or the like removed from the projector and receptor portions 160 and 162 of the sensors 156 and 158 can be prevented from adhering again to the portions 160 and 162, and besides, floating dust or the like in the housing 138 can be efficiently discharged from the housing 138.

Figure 14:
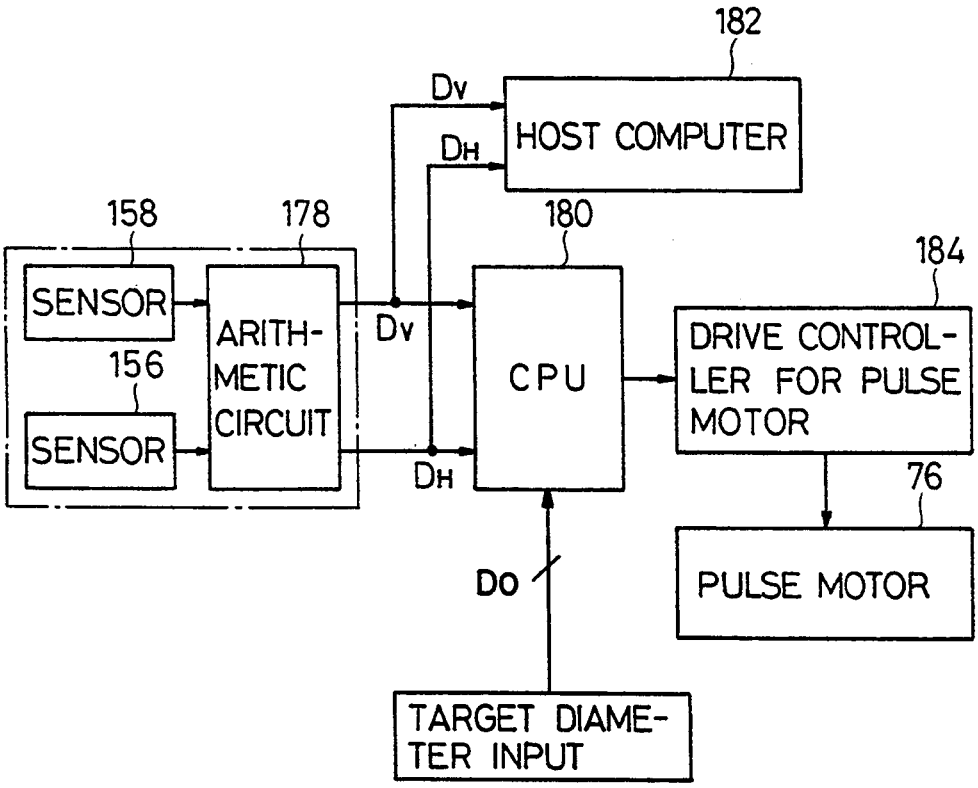
FIG. 14 is a block diagram showing a control device for a pulse motor.

The values of the diametrical widths of the tobacco rod $T_W$ measured individually by means of the sensors 156 and 158 are utilized for the drive control of the adjusting device 73 of the second upper mold 46, that is, the pulse motor 76. A control circuit for the motor 76 is shown in FIG. 14.

The sensors 156 and 158 are connected to a central processing unit or CPU 180 through an arithmetic circuit 178. The arithmetic circuit 178 calculates diametrical widths $D_H$ and $D_V$ of the tobacco rod $T_W$ with respect to two directions perpendicular to each other in the aforesaid manner in response to the sensor signals, that is, the pulse signals from the individual sensors, and supplies these diametrical widths $D_H$ and $D_V$ to the CPU 180. The diametrical widths $D_H$ and $D_V$ are supplied to a host computer 182, as well as to the CPU 180, and the computer 182 utilizes the measured diametrical widths $D_H$ and $D_V$ as data for quality control, for example.

Meanwhile, a target value of the diameter can be applied to the CPU 180, and the manipulated variable of the pulse motor 76, that is, a target rotational angle of the output shaft of the motor 67, is calculated in the CPU 180 in accordance with the target diameter $D_O$ and the measured diametrical widths $D_H$ and $D_V$. The computed target rotational angle is supplied to a drive controller 184 of the pulse motor 76, whereupon the controller 184 controls the drive of the motor 76 so that the actual rotational angle of the motor 76 is equal to the computed target rotational angle.

Figure 15:
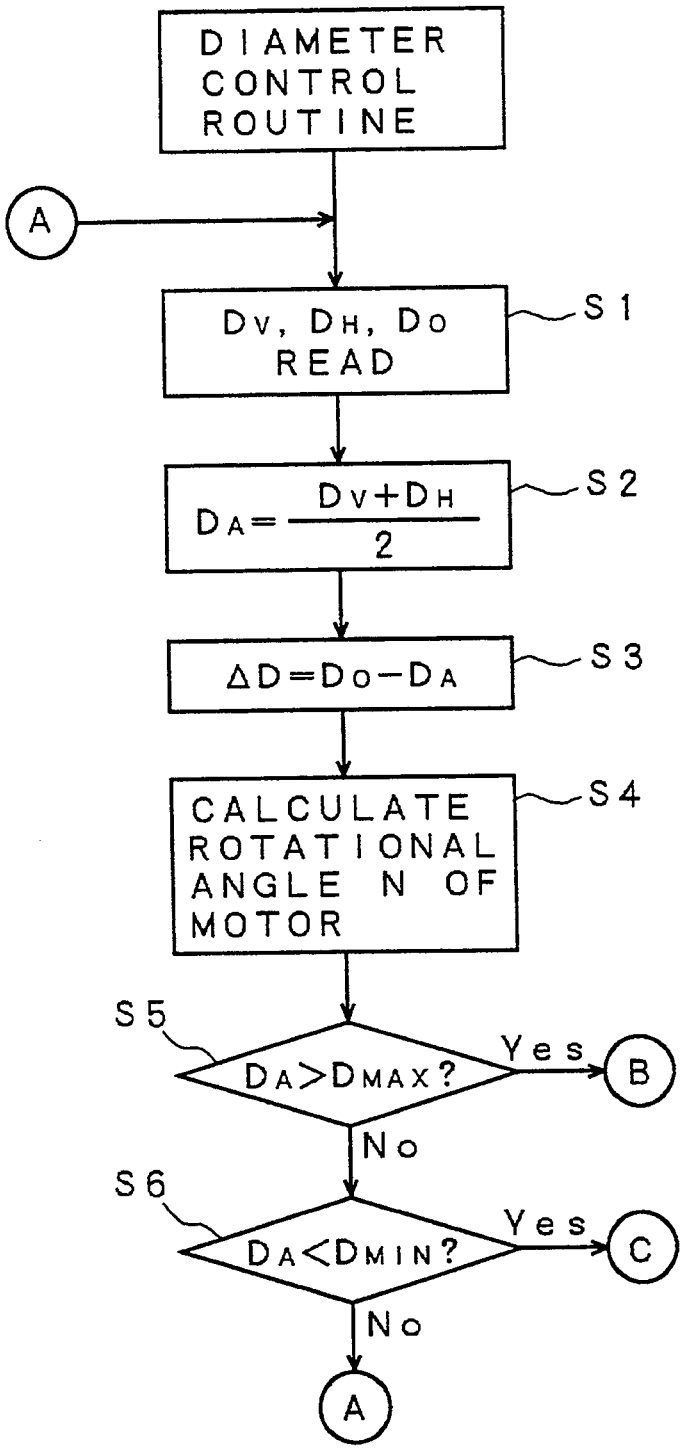
FIGS. 15, 16 and 17 are flow charts showing a diameter control routine.
Figure 16:
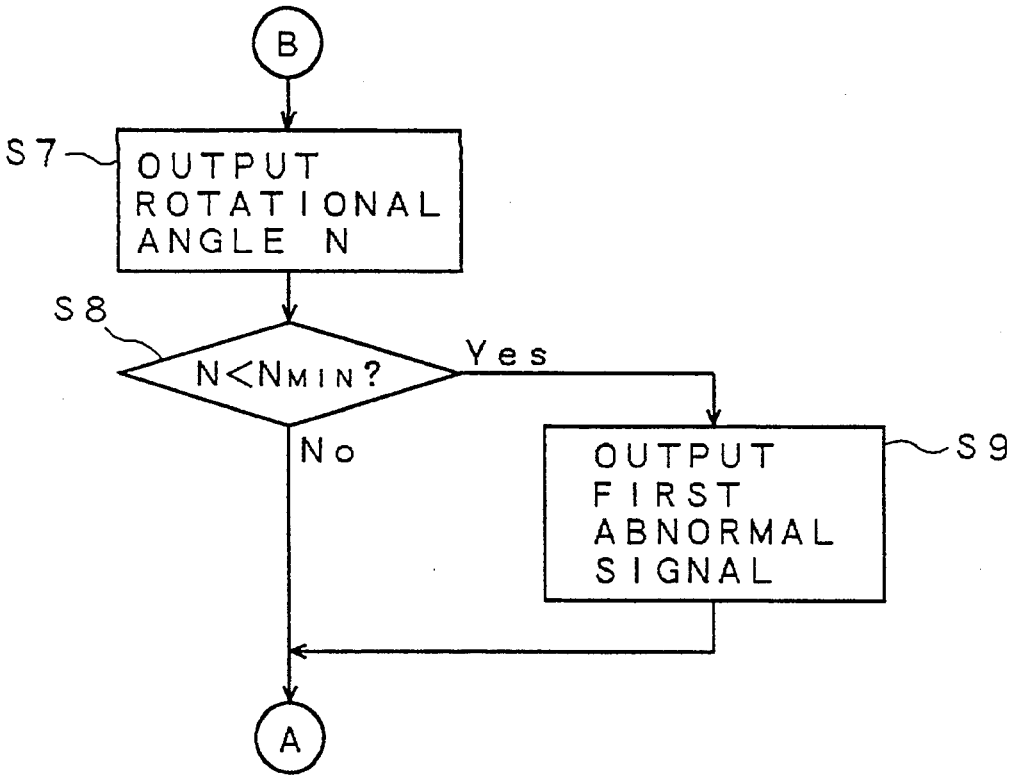
Figure 17:
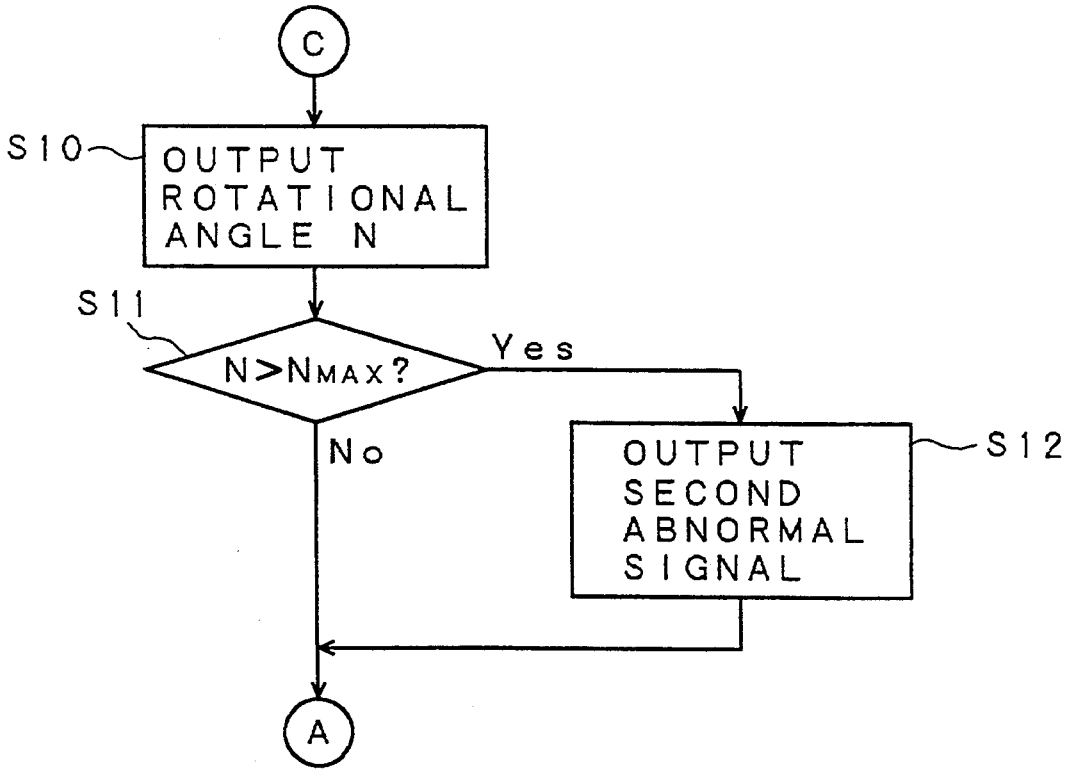

The above-described diameter control routine is shown in the flow charts of FIGS. 15, 16 and 17. Referring now to these flow charts, the diameter control routine will be described.

[Diameter Control Routine]

First, the CPU 180 reads the diametrical widths $D_H$, $D_V$ and $D_O$ (Step S1), and calculates an average diameter $D_A$ of the tobacco rod $T_W$ on the basis of the diametrical widths $D_H$ and $D_V$ according to the following equation (Step S2).

$$D_A=(D_H+D_V)/2.$$

The average diameter $D_A$ of the tobacco rod $T_W$, computed according to this equation, is a value which accurately represents the virtual diameter of the rod $T_W$ even if the travel of the rod $T_W$ is subject to any deflection, or if the profile of the rod $T_W$ is elliptic.

A diameter deviation $\Delta D$ between the target diameter $D_O$ and the average diameter $D_A$ is calculated according to the following equation (Step S3), and a rotational angle N of the pulse motor 76 is calculated on the basis of the diameter deviation $\Delta D$ (Step S4).

$$\Delta D=D_O-D_A.$$

Figure 18:
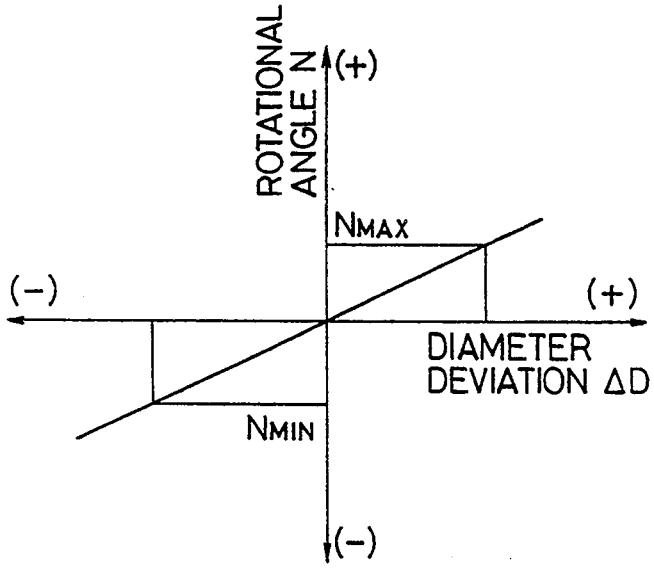
FIG. 18 is a graph showing the relationship between the rotational angle of the pulse motor and the deviation between a target diameter and the actual diameter of the formed tobacco rod.

More specifically, the rotational angle N of the motor corresponding to the diameter deviation $\Delta D$ is calculated with reference to the graph of FIG. 18 in Step S4. Thus, as seen from the graph of FIG. 18, the greater the value of the diameter deviation $\Delta D$, positive or negative, the greater the value of the rotational angle N, positive or negative, is.

When the rotational angle N of the motor is computed, whether or not the average diameter $D_A$ is larger than a maximum allowable diameter $D_{MAX}$ and whether or not the average diameter $D_A$ is smaller than a minimum allowable diameter $D_{MIN}$ are determined in succession in Steps S5 and S6, respectively. If the decisions in these steps are NO, then it is concluded that the computed average diameter $D_A$ is within an allowable range. In this case, therefore, the program returns to Step S1 without the drive of the pulse motor 76, and the process of Step S1 and its subsequent processes are executed repeatedly.

If the decision in Step S5 is YES, however, the program proceeds to Step S7 of FIG. 16, whereupon the computed rotational angle N of the pulse motor 76 is delivered from the CPU 180 to the drive controller 184. Thereupon, the controller 184 actually drives the pulse motor 76. Where the decision of Step S5 is YES, in this case, the diameter deviation $\Delta D$ takes a negative value, so that the rotational angle N of the motor also takes a negative value. Accordingly, the pulse motor 76 is rotated in a direction such that the second upper mold 46 is rocked toward the lower mold 30. As a result, the sectional area of the formation path for the tobacco rod $T_W$, which is defined by the arcuate groove 50 of the second upper mold 46 and the traveling groove 32 of the lower mold 30, is substantially diminished, so that the diameter of the tobacco rod $T_W$ formed thereafter is reduced toward the target diameter value $D_O$.

After the rotational angle N of the motor is outputted, whether or not the value of the angle N is smaller than a lower limit value $N_{MIN}$ is determined in Step S8. If the decision in Step S8 is NO, the program returns to Step S1 of FIG. 15, whereupon the process of Step S1 and its subsequent processes are executed repeatedly. If the decision in Step S8 is YES, on the other hand, a first abnormal signal, which indicates that the diameter of the tobacco rod $T_W$ is extraordinarily large, is outputted in Step S9. Thus, if the rotational angle N is smaller than the lower limit value $N_{MIN}$, then it is concluded that the diameter of the tobacco rod $T_W$ is too large or beyond the allowable limits, as seen from FIG. 18. Preferably, in this situation, the first abnormal signal should be outputted at once to inform an operator of the abnormal state. According to the flow charts, the program returns from Step S9 to Step S1 after the first abnormal signal is outputted. Alternatively, however, the program may be designed so that the CPU 180 outputs a signal for stopping the operation of the cigarette production machine after the process of Step 9 is executed and the execution of the diameter control routine is finished.

If the decision in Step S6 is YES, on the other hand, the program proceeds to Step S10 of FIG. 17, whereupon the computed rotational angle N is outputted. If the decision in Step S6 is YES, in this case, the diameter deviation $\Delta D$ takes a positive value. In order to rock the second upper mold 46 away from the lower mold 30, therefore, the pulse motor 76 is rotated in the direction opposite to the direction for the aforesaid case, whereby the diameter of the tobacco rod $T_W$ is increased toward the target diameter value $D_O$.

After the rotational angle N is outputted, also in this case, whether or not the value of the angle N is larger than the upper limit value $N_{MAX}$ is determined in Step S11. If the decision in Step S11 is YES, a second abnormal signal, which indicates that the diameter of the tobacco rod $T_W$ is extraordinarily small, is outputted in Step S12 for the same reason as aforesaid, whereupon the program returns to Step S1. Also in this case, the CPU 180 can output the signal for stopping the operation of the cigarette production machine after the second abnormal signal is outputted.

According to the diameter control routine described above, if the diameter of the tobacco rod $T_W$ calculated in accordance with the sensor signals from the sensors 156 and 158, that is, the average diameter $D_A$, is deviated from the allowable range (between the maximum diameter $D_{MAX}$ and the minimum diameter $D_{MIN}$), the pulse motor 76 is rotated in a predetermined direction, so that the position of the second upper mold 46 with respect to the lower mold 30 is adjusted. In this manner, the diameter of the tobacco rod $T_W$ can be automatically set within the allowable range.

Thus, the diameter of the tobacco rod $T_W$ or cigarettes manufactured by means of the cigarette production machine can be stabilized. Accordingly, the width of the lap portion of the paper 22 of the tobacco rod $T_W$ can be maintained with reliability, so that the lap portion is subject to no bonding failure. If the diameter of the cigarettes is stabilized, moreover, a tip paper piece can be wound with stability, thereafter, to connect each cigarette and a filter plug.

It is to be understood that the present invention is not limited to the embodiment described above, and that various changes and modifications may be effected therein by one skilled in the art without departing from the scope or spirit of the invention. If the second upper mold is supported so as to be shiftable in the vertical direction, for example, its position with respect to the lower mold 30 can be adjusted as it moves up and down.

According to the foregoing embodiment, moreover, the sensors 156 and 158 are contained in the same housing. Alternatively, however, one of these sensors may be located on the downstream side of the density measuring section. In short, the sensors 156 and 158 can be positioned without any special restrictions.

According to the embodiment described herein, furthermore, the diameter of the tobacco rod $T_W$ is obtained from the simple average of the diametrical widths detected by means of the sensors 156 and 158. However, the average diameter $D_A$ may be computed by various methods. In consideration of the manufacturing processes for the tobacco rod $T_W$, for example, the diameter of the tobacco rod $T_W$ may be obtained from a weighted average of the diametrical widths measured by the sensors.

What is claimed is:

1. An apparatus for controlling the diameter of cigarettes manufactured by means of a cigarette production machine, which includes a lower mold defining the path of travel of a paper supplied with shredded tobacco, the lower mold forming the paper into a U-shaped configuration as the paper travels, the U-shaped paper having a pair of sides and a curved portion connecting the sides and enveloping the shredded tobacco from below, a first upper mold located right over the lower mold, the first upper mold forming the one side of the U-shaped paper into an arcuate configuration as the paper travels, the formed one side enveloping the shredded tobacco from above, a second upper mold located on the downstream side of the first upper mold with respect to the path of travel, the second upper mold forming the other side of the paper into an arcuate configuration so that the other side is lapped on the one side as the paper travels, the formed other side enveloping the shredded tobacco from above, paste applying means for applying paste to the other side edge of the paper before the paper reaches the second upper mold, so that the opposite side edges of the paper are bonded to each other when the other side of the paper is formed into the arcuate configuration, whereby a tobacco rod is formed such that the shredded tobacco is entirely enveloped in the paper and cutting means for cutting the formed tobacco rod into individual cigarettes with a predetermined length, said apparatus comprising:

supporting means for supporting the second upper mold right over the lower mold;

adjusting means for varying the position of the second upper mold with respect to the lower mold in cooperation with said supporting means, thereby adjusting the diameter of the tobacco rod to be formed;

measuring means for measuring diametrical widths of the tobacco rod or cigarettes with respect to different directions and outputting measurement results; and control means for controlling the adjusting means in accordance with the measurement results so that the diameter of the tobacco rod to be formed is within an allowable range, wherein said measuring means includes a pair of optical sensors for detecting diametrical widths of the tobacco rod with respect to two directions perpendicular to each other, wherein each said sensor includes a projector portion for emitting laser beams to the tobacco rod, a receptor portion for receiving the laser beams from the projector portion and outputting a detection signal corresponding to that part of the laser beams intercepted by the tobacco rod, and an arithmetic unit for calculating the diametrical width of the tobacco rod in accordance with the detection signal from the receptor portion, wherein said measuring means further includes a housing containing the pair of sensors and allowing the passage of the tobacco rod therein and a holder in the housing for guiding the tobacco rod in transit, wherein said holder includes an inlet piece for introducing the tobacco rod into the housing, an outlet piece for discharging the tobacco rod from the housing, and an intermediate piece located between the inlet piece and the outlet piece, said pieces being each formed of a pipe member for guiding the tobacco rod and situated on a same axis with one another, the projector and receptor portions of one of said paired sensors facing each other across a gap between the inlet piece and the intermediate piece, and the projector and receptor portions of the other sensor facing each other across a gap between the intermediate piece and the outlet piece, and wherein said measuring means further includes cleaning means for cleaning the respective projector and receptor portions of the sensors by blowing compressed air against the projector and receptor portions.

2. An apparatus according to claim 1, wherein said cleaning means includes jets in the intermediate piece, through which the compressed air is ejected toward the respective projector and receptor portions of the sensors.

3. An apparatus according to claim 2, wherein said cleaning means further includes a duct hole through which air in the housing is discharged.

4. An apparatus for controlling the diameter of cigarettes manufactured by means of a cigarette production machine, which includes a lower mold defining the path of travel of a paper supplied with shredded tobacco, the lower mold forming the paper into a U-shaped configuration as the paper travels, the U-shaped paper having a pair of sides and a curved portion connecting the sides and enveloping the shredded tobacco from below, a first upper mold located right over the lower mold, the first upper mold forming the one side of the U-shaped paper into an arcuate configuration as the paper travels, the formed one side enveloping the shredded tobacco from above, a second upper mold located on the downstream side of the first upper mold with respect to the path of travel, the second upper mold forming the other side of the paper into an arcuate configuration so that the other side is lapped on the one side as the paper travels, the formed other side enveloping the shredded tobacco from above, paste applying means for applying paste to the other side edge of the paper before the paper reaches the second upper mold, so that the opposite side edges of the paper are bonded to each other when the other side of the paper is formed into the arcuate configuration, whereby a tobacco rod is formed such that the shredded tobacco is entirely enveloped in the paper, and cutting means for cutting the formed tobacco rod into individual cigarettes with a predetermined length, said apparatus comprising:

supporting means for supporting the second upper mold right over the lower mold;

adjusting means for varying the position of the second upper mold with respect to the lower mold in cooperation with said supporting means, thereby adjusting the diameter of the tobacco rod to be formed;

measuring means for measuring diametrical widths of the tobacco rod or cigarettes with respect to different directions and outputting measurement results; and control means for controlling the adjusting means in accordance with the measurement results so that the diameter of the tobacco rod to be formed is within an allowable range, further comprising a hinge vertically swingably supporting one side edge of said second upper mold on a lower mold side; and said adjusting means including a feed screw having a large-diameter screw portion and a small-diameter screw portion at lower and upper end portions thereof, respectively, the large-diameter screw portion being screwed into a stationary member, the small-diameter screw portion projecting from the stationary member, a lift member fitted on the small-diameter screw portion of the feed screw and movable only in a vertical direction, the lift member having a pusher element contacting a second side edge of said second upper mold from below, driving mans for rotating the feed screw in forward and reverse directions, and holding means for holding the second side edge of said second upper mold and the pusher element of the feed screw.

5. In a cigarette producing machine having a lower mold, a cigarette rod diameter controller apparatus comprising:

an upper mold, facing the lower mold such that a void is formed therebetween for shaping the rod, the upper mold being vertically displaceable a void-distance relative to the lower mold;

an adjustment mechanism, operatively connected to the upper mold, for selectively increasing and decreasing the void-distance between the upper mold and the lower mold;

at least one sensor measuring at least one diameter of the rod;

a controller, operatively connected to the adjustment mechanism and the at least one sensor, respectively, for producing an adjustment signal as a function of the at least one diameter, and for causing the adjustment mechanism to selectively increase and decrease the void-distance as a function of the adjustment signal, a threaded shaft, the shaft connecting the upper and lower molds; and means, operatively connected to the shaft and the lower mold and the controller, respectively, for causing the shaft to rotate such that the void-distance is selectively increased and decreased.

6. In a cigarette producing machine having a lower mold, a cigarette rod diameter controller apparatus comprising:

an upper mold, facing the lower mold such that a void is formed therebetween for shaping the rod, the upper mold being vertically displaceable a void-distance relative to the lower mold;

an adjustment mechanism, operatively connected to the upper mold, for selectively increasing and decreasing the void-distance between the upper mold and the lower mold;

at least one sensor measuring at least one diameter of the rod;

a controller, operatively connected to the adjustment mechanism and the at least one sensor, respectively, for producing an adjustment signal as a function of the at least one diameter, and for causing the adjustment mechanism to selectively increase and decrease the void-distance as a function of the adjustment signal, wherein each of the at least one sensor includes a projector portion for emitting radiation; and a receptor portion for receiving the radiation from the projector portion, the apparatus further including cleaning means for cleaning the respective projector and receptor portion of each of the at least one sensor.

7. An apparatus according to claim 6, wherein:

the cleaning means cleans by blowing air against projector and receptor portions, respectively.

8. In a cigarette producing machine having a path along which passes a cigarette rod as it is being produced and a cigarette rod diameter controller for controlling a diameter of the cigarette rod, a diameter sensing apparatus comprising:

at least one sensor for sensing at least one diameter of the cigarette rod as it passes a reference point on the path in the cigarette producing machine, each at least one sensor outputting its sensed diameter to the controller, each sensor including a projector portion for emitting radiation; and a receptor portion for receiving the radiation from the projector portion; and cleaning means for cleaning the respective projector and receptor portion of each of the at least one sensor.

9. An apparatus according to claim 8, wherein:

the cleaning means cleans by blowing air against projector and receptor portions, respectively.

* * * * *